US011262688B2

(12) United States Patent
Park et al.

(10) Patent No.: US 11,262,688 B2
(45) Date of Patent: Mar. 1, 2022

(54) STRUCTURE FOR PROTRUDING HANDLE TO RELEASE DEVELOPER CARTRIDGE

(71) Applicant: HEWLETT-PACKARD DEVELOPMENT COMPANY, L.P., Spring, TX (US)

(72) Inventors: Jin Sam Park, Suwon-si (KR); Jin Hong Kim, Suwon-si (KR); Seong Woong Yang, Hanam-si (KR); Min Woo Kang, Hwaseong-si (KR); Yong Hun Kim, Hwaseong-si (KR); Jeong Sup Sim, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/050,600

(22) PCT Filed: Oct. 15, 2018

(86) PCT No.: PCT/KR2018/012078
§ 371 (c)(1),
(2) Date: Oct. 26, 2020

(87) PCT Pub. No.: WO2019/231059
PCT Pub. Date: Dec. 5, 2019

(65) Prior Publication Data

US 2021/0240127 A1 Aug. 5, 2021

(30) Foreign Application Priority Data

May 28, 2018 (KR) ..... 10-2018-0060633

(51) Int. Cl.
*G03G 21/16* (2006.01)
*G03G 21/18* (2006.01)

(52) U.S. Cl.
CPC ..... *G03G 21/1623* (2013.01); *G03G 21/1676* (2013.01); *G03G 21/1846* (2013.01); *G03G 2221/1846* (2013.01)

(58) Field of Classification Search
CPC ..... G03G 21/1623; G03G 21/1676; G03G 21/1846; G03G 2221/163; G03G 2221/1846
See application file for complete search history.

(56) References Cited

U.S. PATENT DOCUMENTS

2006/0209145 A1 9/2006 Yazawa et al.
2012/0195628 A1 8/2012 Kato
(Continued)

FOREIGN PATENT DOCUMENTS

EP 2919075 9/2015
JP 2001-42622 2/2001
(Continued)

*Primary Examiner* — Sophia S Chen
(74) *Attorney, Agent, or Firm* — Staas & Halsey LLP

(57) ABSTRACT

A printer includes a main body including a printing unit for printing an image, a developer cartridge for accommodating a developer to be supplied to the printing unit and removable from the main body, a releasing member provided in the main body and pushing the developer cartridge in a removal direction to move the developer cartridge from a mounting position where the developer cartridge is locked to the main body to a removal position where the developer cartridge is unlocked, and a handle provided on the developer cartridge. The handle moves in conjunction with the movement of the developer cartridge from the mounting position to the removal position of the developer cartridge such that the handle is switched from a first position adjacent to a side of the developer cartridge to a second position protruding from the side of the developer cartridge, so that the handle can be gripped.

15 Claims, 8 Drawing Sheets

(56) References Cited

U.S. PATENT DOCUMENTS

| | | | | |
|---|---|---|---|---|
| 2015/0261176 | A1 | 9/2015 | Moon et al. | |
| 2016/0357126 | A1* | 12/2016 | Kim | G03G 21/1676 |
| 2018/0267459 | A1* | 9/2018 | Sato | G03G 21/105 |

FOREIGN PATENT DOCUMENTS

| | | |
|---|---|---|
| JP | 2003-84646 | 3/2003 |
| JP | 2003241615 | 8/2003 |
| JP | 2009-276718 | 11/2009 |
| JP | 2011-123250 | 6/2011 |
| JP | 2014-109599 | 6/2014 |
| JP | 2016-156855 | 9/2016 |
| KR | 10-2014-0095404 | 8/2014 |
| KR | 10-2016-0002632 | 1/2016 |

* cited by examiner

[Fig. 1]
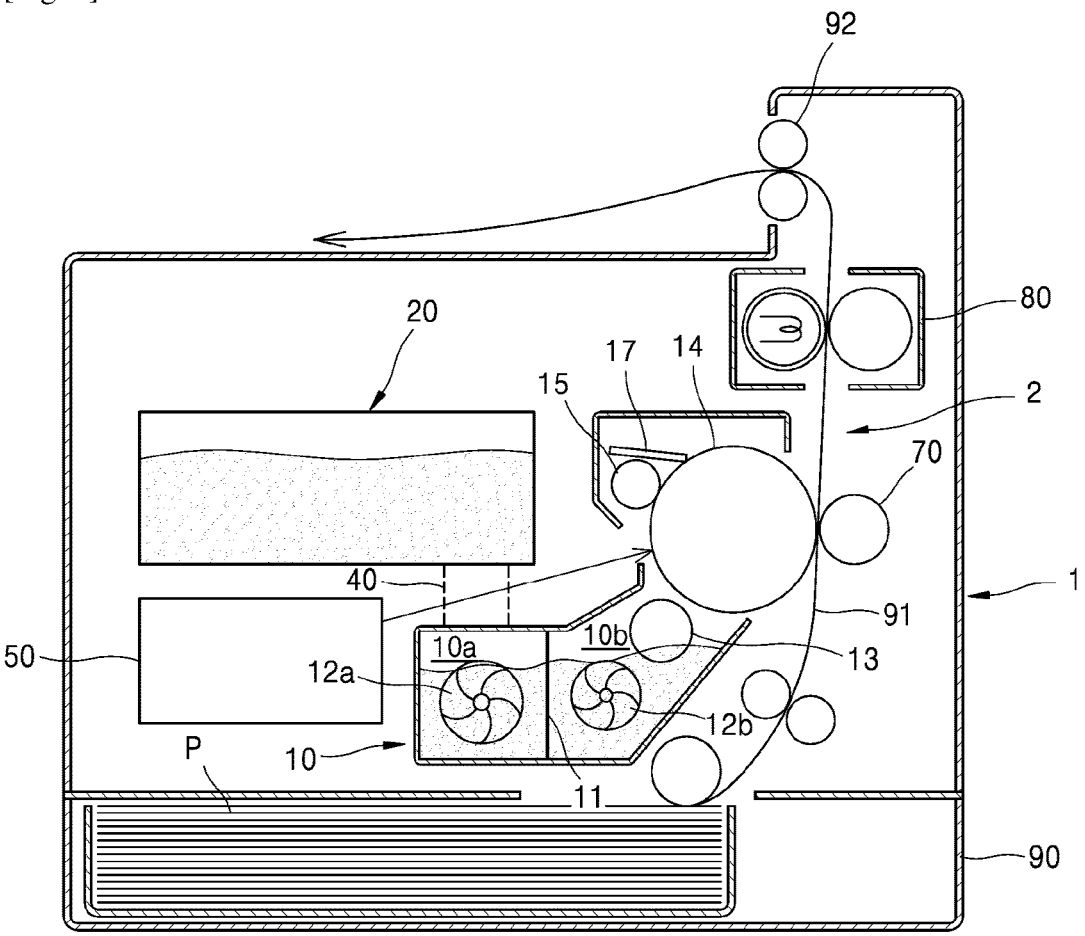

[Fig. 2]
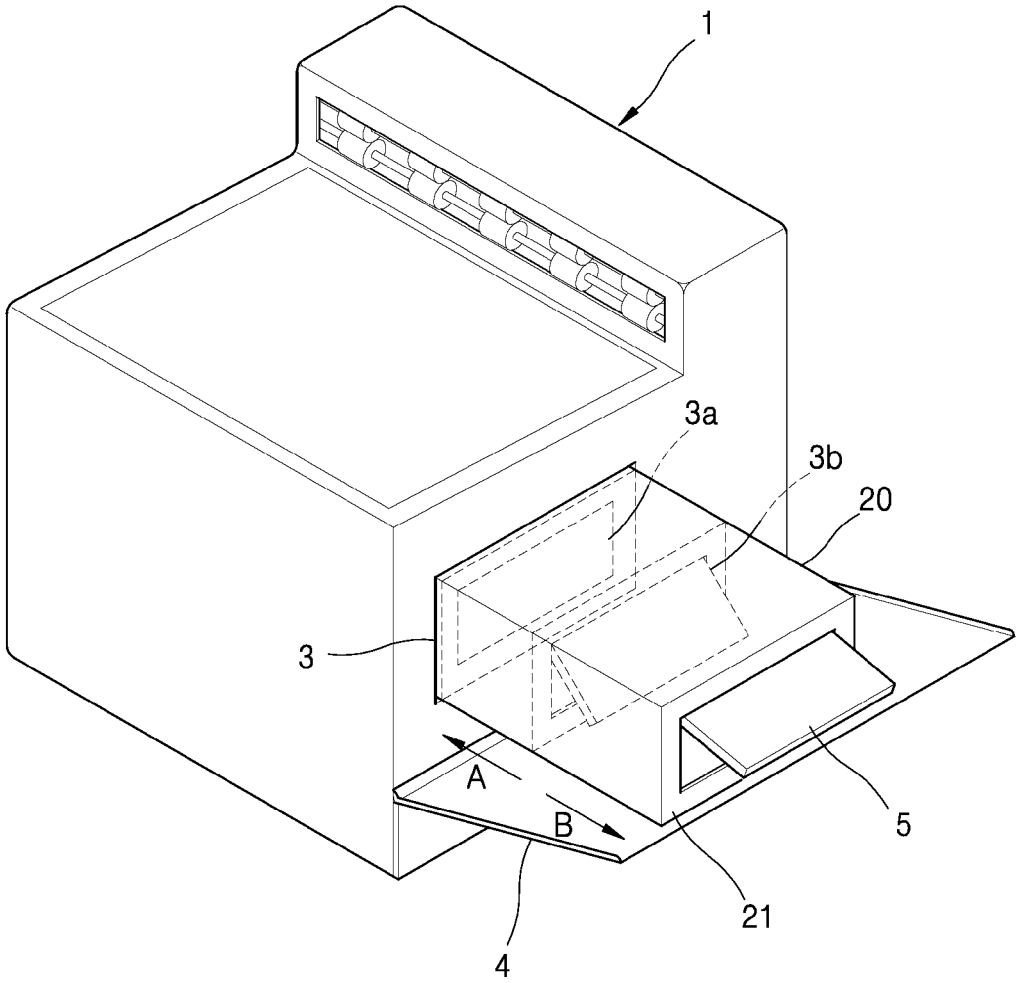

[Fig. 3]
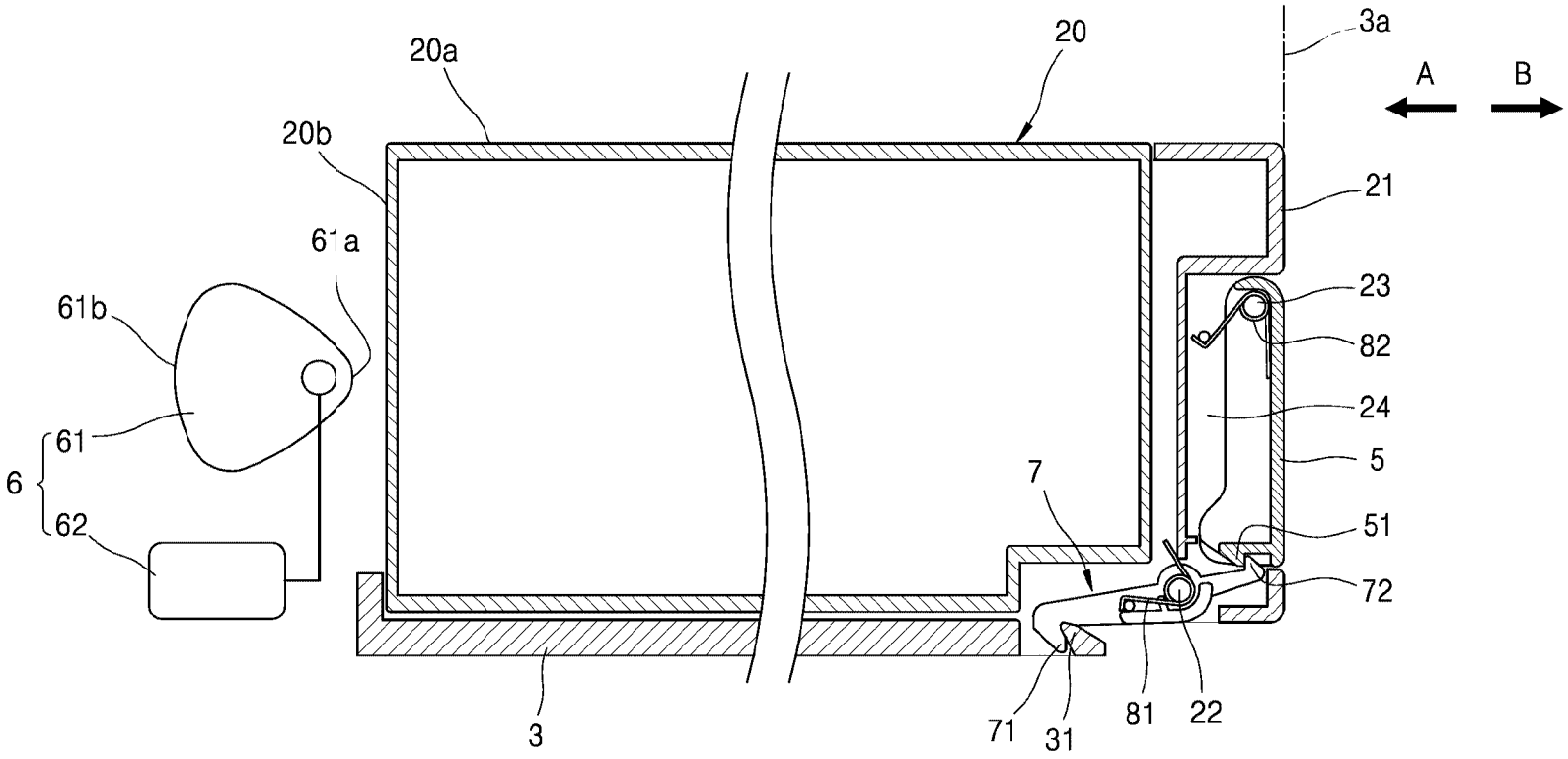

[Fig. 4]
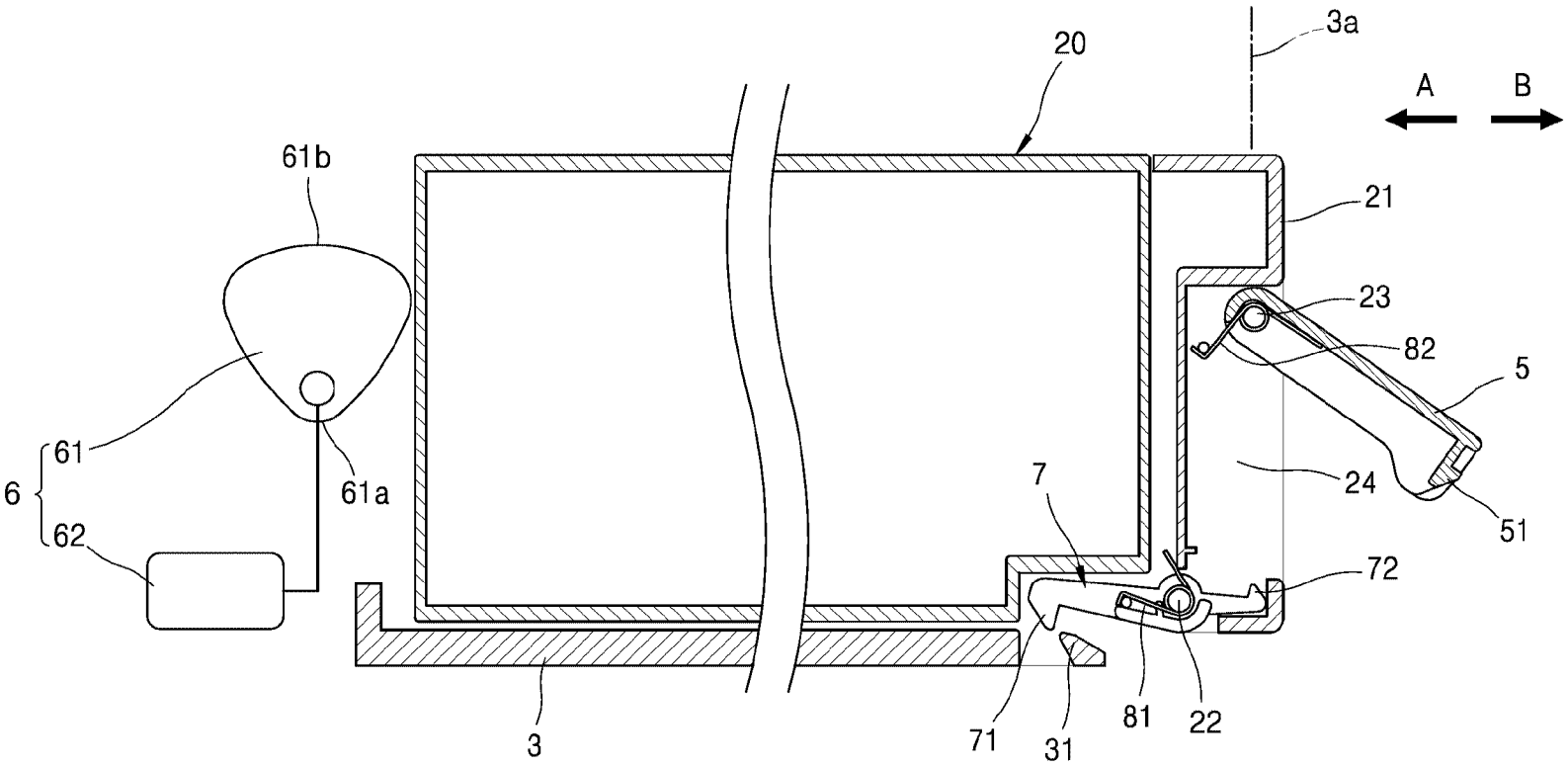

[Fig. 5]
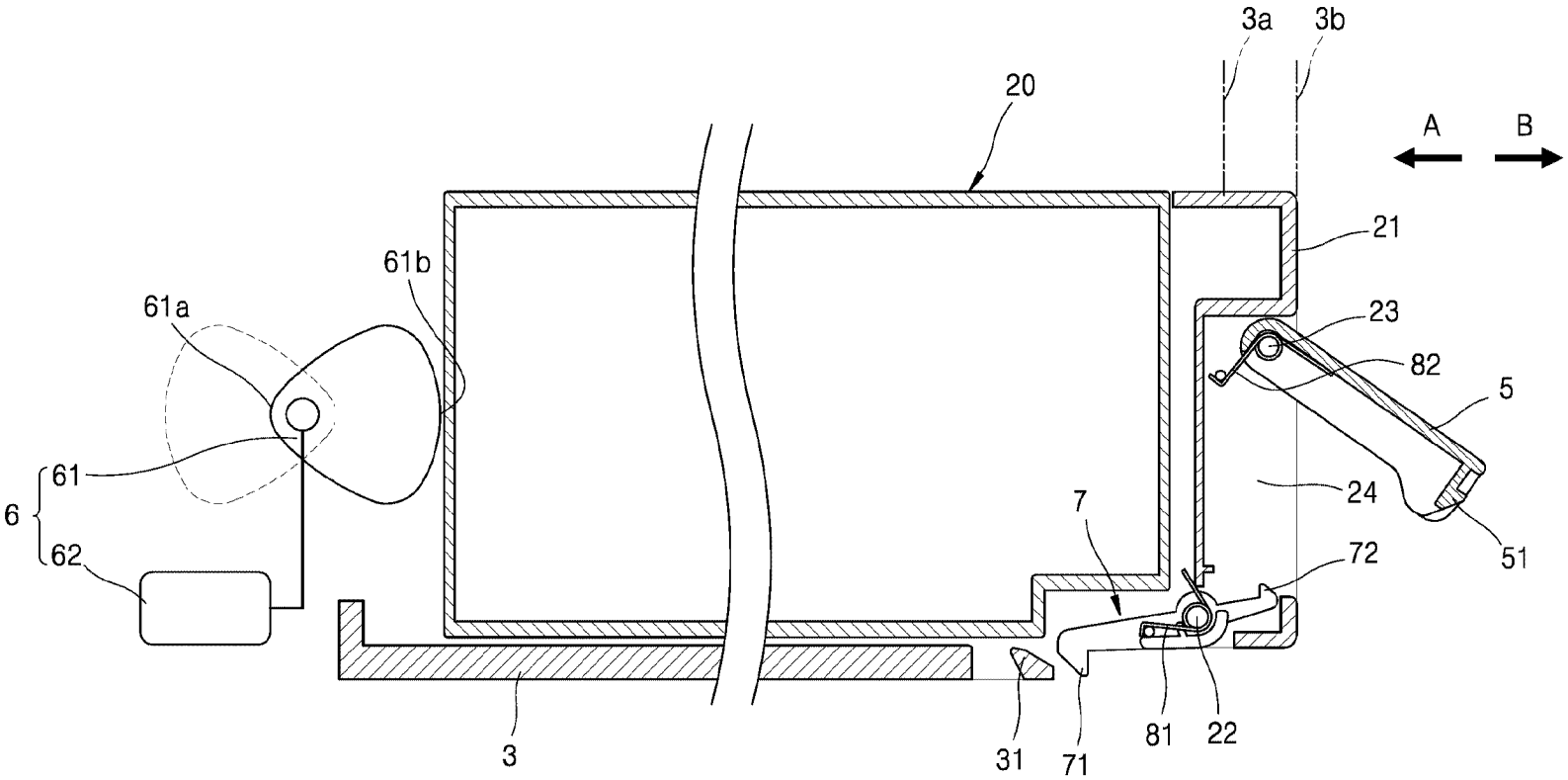

[Fig. 6]
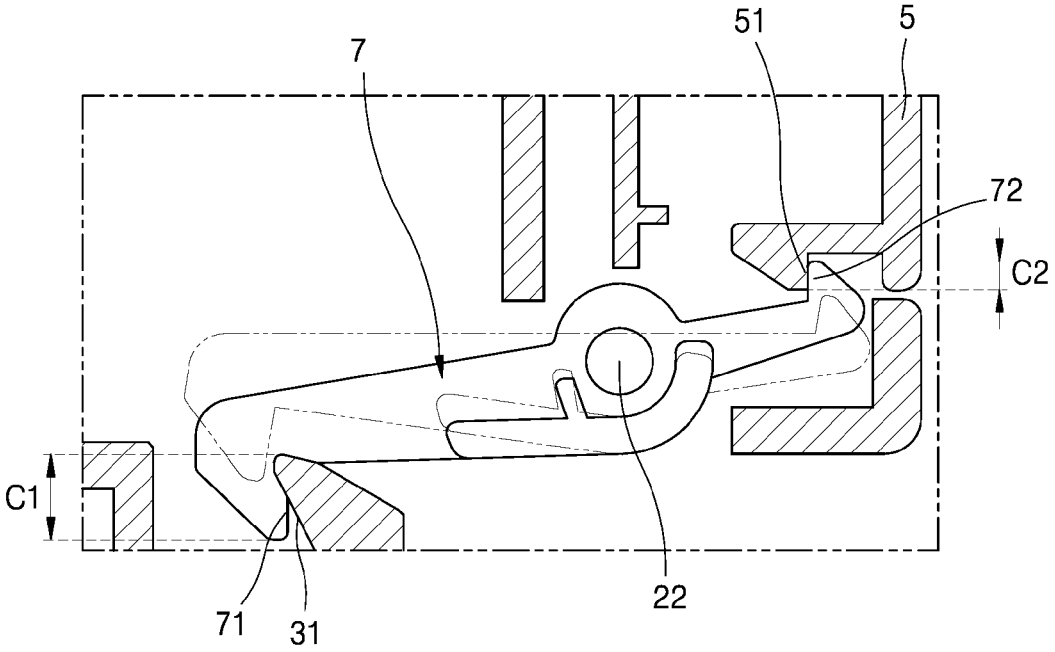

[Fig. 7]
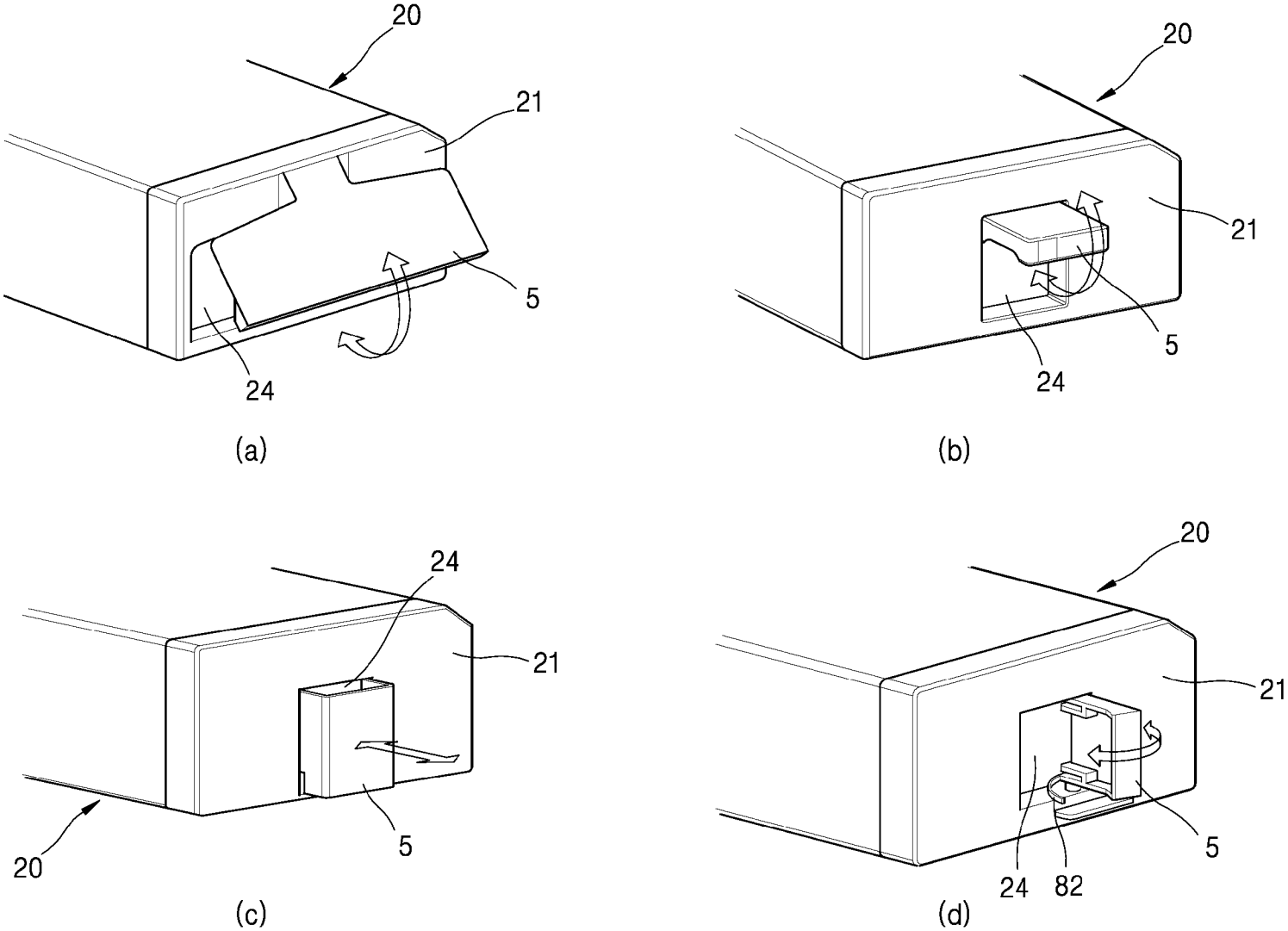

[Fig. 8]
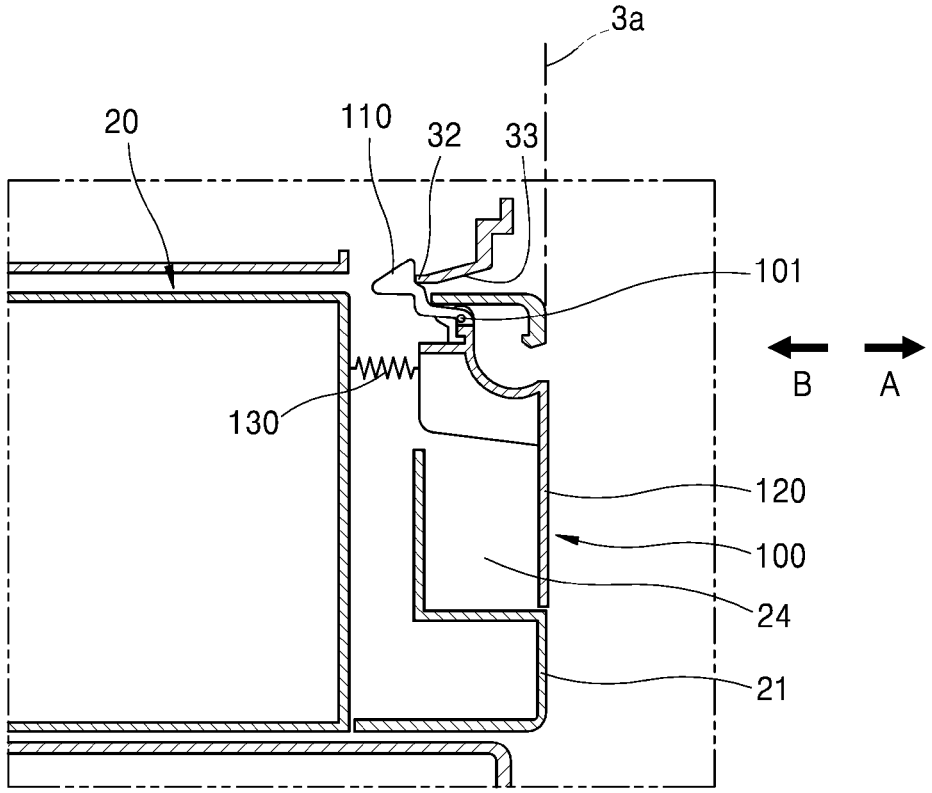
[Fig. 9]
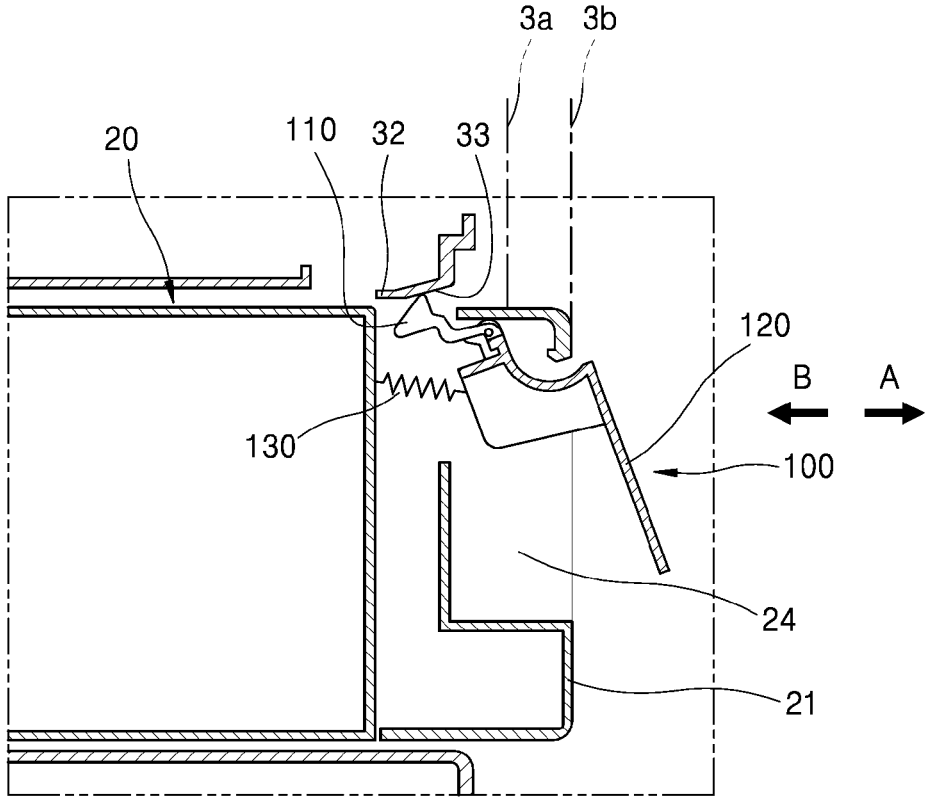

STRUCTURE FOR PROTRUDING HANDLE TO RELEASE DEVELOPER CARTRIDGE

CROSS REFERENCE TO RELATED APPLICATIONS

This application is filed under 35 U.S.C. 0.371 as a National Stage of PCT International Application No. PCT/KR2018/012078, filed on Oct. 15, 2018, in the Korean Intellectual Property Office, which claims the priority benefit of Korean Patent Application No. 10-2018-0060633, filed on May 28, 2018, in the Korean Intellectual Property Office. The disclosures of PCT International Application No. PCT/KR2018/012078 and Korean Patent Application No. 10-2018-0060633 are incorporated by reference herein in their entireties.

BACKGROUND ART

A printer using an electrophotographic method is a printer that supplies toner to an electrostatic latent image formed on a photoconductor to form a visible toner image on the photoconductor, transfers the toner image to a printing medium via an intermediate transfer medium or directly to a printing medium, and then fixes the transferred toner image on the printing medium.

The toner is a consumable developer. For example, the printer employs a structure capable of replenishing the developer. For example, the developer may be accommodated in a developer cartridge, and the developer cartridge may be removably mounted to a main body of the printer. When the developer accommodated in the developer cartridge is exhausted, the developer cartridge is removed from the main body of the printer, and a new developer cartridge may be mounted to the main body.

BRIEF DESCRIPTION OF DRAWINGS

FIG. 1 is a configuration diagram of an example of an electrophotographic printer;

FIG. 2 is a perspective view of an example of an electrophotographic printer showing mounting/removal of a developer cartridge;

FIGS. 3 to 5 are views of a process in which a developer cartridge moves from a mounting position to a removal position, wherein FIG. 3 shows a state in which the developer cartridge is located in the mounting position, FIG. 4 shows a state in which locking of the developer cartridge is released, and FIG. 5 shows a state in which the developer cartridge is located in the removal position;

FIG. 6 shows a behavior of a rocker arm in a process of switching a handle from a second position to a first position;

FIG. 7 shows various forms of a handle; and

FIGS. 8 and 9 are cross-sectional views showing an example of a developer cartridge employing a handle formed integrally with a rocker arm, wherein FIG. 8 shows a state in which the developer cartridge is located in a mounting position, and FIG. 9 shows a state in which the developer cartridge is located in a removal position.

MODE FOR THE INVENTION

An example embodiment of a printer may include: a main body including a printing unit to print an image on a printing medium and including an interior space to accommodate a removable developer cartridge that includes a developer to be supplied to the printing unit; a releasing member, provided in a rear portion of the interior space of the main body, that when the developer cartridge is installed in the main body and is to be removed from the main body, is to rotate so as to move the developer cartridge in a removal direction to remove the developer cartridge from the main body; and a latching portion, provided in a front portion of the interior space of the main body, that when the developer cartridge is installed in the main body is latched to a portion of the developer cartridge so that a handle of the developer cartridge is maintained in a first position, and when the developer cartridge is removed from the main body the latching portion is unlatched from the portion of the developer cartridge so that the handle is concurrently moved to a second position to protrude from the developer cartridge.

The developer cartridge may include: a rocker arm provided on the developer cartridge to switch between a third position at which the rocker arm holds the developer cartridge at a mounting position where the developer cartridge is locked to the main body and holds the handle at the first position, and a fourth position at which the rocker arm allows the developer cartridge to move to a removal position where the developer cartridge is unlocked from the main body and allows the handle to be switched to the second position; a first elastic member to apply an elastic force to the rocker arm in a direction so that the rocker arm is held in the third position; and a second elastic member to apply an elastic force to the handle in a direction to switch the handle to the second position.

The rocker arm may be switched from the third position to the fourth position by the movement of the developer cartridge to the removal position.

The rocker arm may have a first locking portion and a second locking portion, the portion of the developer cartridge may correspond to the first locking portion and the latching portion may be to latch to the first locking portion when the rocker arm is located at the third position, and the handle may be provided with a handle latching portion to latch the second locking portion when the rocker arm is located at the third position.

The rocker arm may include an intermediate position between the third position and the fourth position, where the latching of the first locking portion and the latching portion is maintained and the latching of the second locking portion and the handle latching portion is released.

A first latching distance between the first locking portion and the latching portion may be greater than a second latching distance between the second locking portion and the handle latching portion.

The handle may include a locking portion, and the portion of the developer cartridge may correspond to the locking portion and the locking portion may be latched to the latching portion when the handle is at the first position to lock the developer cartridge to a mounting position where the developer cartridge is locked to the main body and the locking portion may be released from the latching portion when the handle is at the second position.

The developer cartridge may include an elastic member to apply an elastic force to the handle in a direction to switch the handle to the first position.

The main body may include an interference portion to interfere with the locking portion to hold the handle in the second position when the developer cartridge moves from the mounting position to a removal position where the developer cartridge is unlocked from the main body.

Am example developer cartridge, which is installable in a printer, may include: a body having a rear side and a front side; a handle, provided on the front side of the body, movable between a first position at which the handle is adjacent to the front side of the body to a second position at which the handle protrudes from the front side of the body; and a rocker arm provided in the developer cartridge to move from a third position, at which the developer cartridge is locked to a main body of the printer when the developer cartridge is installed in the main body, to a fourth position, at which the developer cartridge is unlocked from the main body when the developer cartridge is removed from the main body by a force applied to the rear side of the body in a rear to front direction of the body, The handle may be to move from the first position to the second position when the rocker arm moves from the third position to the fourth position.

The developer cartridge may further include: a first elastic member to apply an elastic force to the rocker arm in a direction so that the rocker arm is held in the third position; and a second elastic member to apply an elastic force to the handle in a direction to switch the handle to the second position. The rocker arm may have a first locking portion and a second locking portion, the main body of the printer may be provided with a first latching portion to latch the first locking portion when the rocker arm is located at the third position, and the developer cartridge may be provided with a second latching portion to latch the second locking portion when the rocker arm is located at the third position.

A first latching distance between the first locking portion and the first latching portion may be greater than a second latching distance between the second locking portion and the second latching portion.

The rocker arm and the handle may be integrally formed, and the developer cartridge may further include: an elastic member to apply an elastic force to the handle in a direction to switch the handle to the first position.

The main body of the printer may include an interference portion to interfere with the rocker arm to hold the handle in the second position when the developer cartridge is moved from a mounting position where the developer cartridge is locked to the main body to a removal position where the developer cartridge is unlocked from the main body.

The force applied to the rear side of the body of the developer cartridge may be applied by a releasing member provided in the main body of the printer to push the developer cartridge in a removal direction to switch the rocker arm from the third position to the fourth position.

FIG. 1 is a configuration diagram of an example of an electrophotographic printer. Referring to FIG. 1, the electrophotographic printer includes a main body 1 of the electrophotographic printer and a developer cartridge 20 which is removably mounted to the main body 1. The developer cartridge 20 is also referred to as a 'toner cartridge'. The main body 1 includes a printing unit 2 for printing an image on a printing medium P by an electrophotographic method. The printing unit 2 of the example prints an image on the printing medium P by the electrophotographic method. The printing unit 2 may include a developing unit 10, an exposure unit 50, a transfer unit, and a fixing unit 80.

The electrophotographic printer may include the developer cartridge 20 containing a developer. The developer cartridge 20 accommodates the developer to be supplied to the printing unit 2. The developer cartridge 20 is mounted to the main body 1 and connected to the developing unit 10 and the developer accommodated in the developer cartridge 20 is supplied to the developing unit 10. The developer cartridge 20 may be connected to, for example, the developing unit 10 via a supply duct 40. Although not shown in the drawings, a supply unit for regulating a supply amount of the developer may be interposed between the developer cartridge 20 and the developing unit 10. Although not shown in the drawings, the developer cartridge 20 may have a carrying member for carrying the developer contained therein to the supply duct 40. The carrying member may be connected to a driving motor (not shown) provided in the main body 1 when the developer cartridge 20 is mounted to the main body 1.

The developing unit 10 supplies toner to an electrostatic latent image formed on a photosensitive drum 14 to develop the electrostatic latent image into a visible toner image. The developing unit 10 may include the photosensitive drum 14 on which the electrostatic latent image is formed and a developing roller 13 for supplying toner to the electrostatic latent image to develop the electrostatic latent image into a visible toner image. The photosensitive drum 14 is an example of a photoconductor, and may include a conductive metal pipe and a photosensitive layer formed on the periphery thereof. A charging roller 15 is an example of a charger that charges the photosensitive drum 14 to have a uniform surface potential. Instead of the charging roller 15, a charging brush, a corona charger, or the like may be employed. Although not shown in the figure, the developing unit 10 may further include a charging roller cleaner for removing foreign materials such as a developer or dust adhered to the charging roller 15, a cleaning member 17 for removing a developer remaining on a surface of the photosensitive drum 14 after an intermediate transfer process described later below, and a regulating member (not shown) for regulating the amount of a developer supplied to a developing area where the photosensitive drum 14 and the developing roller 13 face each other. The cleaning member 17 may be, for example, a cleaning blade that contacts the surface of the photosensitive drum 14 to scrape a developer. Although not shown in the drawings, the cleaning member 17 may be a cleaning brush that contacts a surface of the photosensitive drum 14 while rotating and scrapes a developer.

A one-component developing system using toner as a developer may be classified into a contact developing method in which the developing roller 13 and the photosensitive drum 14 are rotated in contact with each other and a non-contact developing method in which the developing roller 13 and the photosensitive drum 14 are rotated and located so as to be spaced apart from each other by tens to hundreds of microns.

In the case of a two-component development system using toner and a carrier as a developer, the developing roller 13 is located so as to be spaced apart from the photosensitive drum 14 by tens to hundreds of microns. Although not shown in the drawings, the developing roller 13 may include a hollow cylindrical sleeve to be rotated and a magnetic roller fixedly arranged in the sleeve. The toner is attached to a surface of the magnetic carrier. The magnetic carrier is attached to a surface of the developing roller 13 and carried to a developing area where the photosensitive drum 14 and the developing roller 13 face each other. The toner is supplied to the photosensitive drum 14 by a developing bias voltage applied between the developing roller 13 and the photosensitive drum 14 to develop the electrostatic latent image formed on a surface of the photosensitive drum 14 into a visible toner image.

In the example, a two-component developing method is employed. The inside of the developing unit 10 may be divided into a stirring chamber 10*a* and a developing chamber 10*b* by a barrier wall 11. A developer supplied from the developer cartridge 20 may be flow into, for example, the stirring chamber 10*a*. A stirrer 12*a* axially carries the developer inside the stirring chamber 10*a*. A stirrer 12*b* carries the developer inside the developing chamber 10*b* in a direction opposite the carrying direction of the stirrer 12*a*. The pair of stirrers 12*a* and 12*b* may be implemented, for example, by an auger. Openings for communicating the stirring chamber 10*a* and the developing chamber 10*b* with each other are provided on both sides of the barrier wall 11 in an axial direction, respectively, whereby the developer is circulated inside the stirring chambers 10*a* and 10*b* by the pair of the stirrers 12*a* and 12*b*. While the developer is carried by the stirrers 12*a* and 12*b*, toner is electrically charged by friction with a carrier. The developing roller 13 supplies toner inside the developing chamber 10*b* to the photosensitive drum 14 to develop the electrostatic latent image formed on the surface of the photosensitive drum 14 into a visible toner image.

In a case of the one-component developing method, the developer cartridge 20 receives toner as a developer. In a case of the two-component developing method, toner may be accommodated in the developer cartridge 20, or toner and a carrier may be accommodated. When a trickle developing method is employed, toner and a carrier may be accommodated in the developer cartridge 20.

The exposure unit 50 irradiates light modulated corresponding to image information onto the photosensitive drum 14 to form the electrostatic latent image on the photosensitive drum 14. Examples of the exposure unit 50 include a laser scanning unit (LSU) using a laser diode as a light source or a light emitting diode (LED) exposure unit using an LED as a light source.

The transfer unit transfers a toner image formed on the photosensitive drum 14 to the printing medium P. The transfer unit may include a transfer roller 70. The transfer roller 70 is located facing the photosensitive drum 14. A transfer bias voltage for transferring the toner image formed on the photosensitive drum 14 to the printing medium P is applied to the transfer roller 70.

The fixing unit 80 applies heat and/or pressure to the toner image transferred to the printing medium P to fix the toner image on the printing medium P. A configuration of the fixing unit 80 is not limited to the example shown in FIG. 1.

According to the above configuration, the exposure unit 50 scans the photosensitive drum 14 with light modulated corresponding to image information to be printed, thereby forming the electrostatic latent image on the photosensitive drum 14. The electrostatic latent image on the photosensitive drum 14 is developed into a visible toner image by the developer supplied from the developer cartridge 20 to the developing unit 10. The printing medium P mounted to a paper feeding device 90 is carried between the transfer roller 70 and the photosensitive drum 14 along a paper feeding path 91. The toner image on the photosensitive drum 14 is transferred to the printing medium P by the transfer bias voltage applied to the transfer roller 70. When the printing medium P passes the fixing unit 80, the toner image is fixed to the printing medium P by heat and pressure. The printing medium P to which the toner image is fixed is discharged by a discharge roller 92.

The developer cartridge 20 is mountable to and removable from the main body 1. When the developer accommodated in the developer cartridge 20 is exhausted, the developer cartridge 20 may be replaced with a new developer cartridge 20.

FIG. 2 is a perspective view of an example of a printer. Referring to FIG. 2, the main body 1 of the printer may be provided with a mounting portion 3 to which the developer cartridge 20 is mounted. A door 4 opens and closes a part of the main body 1 to mount/remove the developer cartridge 20 to/from the main body 1. As shown in FIG. 2, the mounting portion(interior space) 3 is exposed when the door 4 is in an open position and the developer cartridge 20 may be slid in a mounting direction A and mounted to the mounting portion 3. When the mounting is completed, the developer cartridge 20 reaches a mounting position 3*a* where the developer cartridge 20 is locked to the main body 1.

A process of removing the developer cartridge 20 from the main body 1 may include a process of releasing the locking of the developer cartridge 20. The developer cartridge 20 is moved to a removal position 3*b* slightly moved in a removal direction B from the mounting position 3*a* by a releasing member 6 (of FIG. 3) described later below. The locking of the developer cartridge 20 to the main body 1 is released in the process of moving the developer cartridge 20 from the mounting position 3*a* to the removal position 3*b*.

For example, the releasing member 6 is provided in a rear portion of the mounting portion(interior space) 3 and pushes the developer cartridge 20 located at the mounting position 3*a* to move from the mounting position 3*a* to the removal position 3*b*. In this state, the developer cartridge 20 may be slid in the removal direction B and removed from the main body 1. A distance between the mounting position 3*a* and the removal position 3*b* is not particularly limited as long as it can be visually confirmed that the developer cartridge 20 is in a removable state.

As described above, at the mounting position 3*a*, the developer cartridge 20 is locked to the main body 1 so that a user cannot arbitrarily remove it. A portion of the developer cartridge 20 facing the door 4, for example, a front portion 21, may have no grooves or protrusions that can be held by a user. Release of the locking of the developer cartridge 20 may be performed by driving the releasing member 6. For example, when a remaining amount of the developer in the developer cartridge 20 reaches a remaining amount as a replacement reference, it is possible to output a replacement signal that a user can perceive to replace the developer cartridge 20 through an output device (not shown) such as a display, a buzzer, a lighting device, or the like. The replacement signal may be, for example, a video signal displayed on a display, a sound signal through a buzzer, an optical signal through a lighting device, or the like. A user may input an operation for requesting replacement of the developer cartridge 20 via an operation panel. A control unit (not shown) may guide a user's operation procedure for replacing the developer cartridge 20, for example, via a display, and a user may replace the developer cartridge 20 in accordance with the guide. In order to prevent an arbitrary replacement of the developer cartridge 20, the operation procedure may include a password input. The control unit operates the releasing member 6 to push the developer cartridge 20 to the removal position 3*b* in the removal direction B in accordance with the user's operation. Then, the locking of the developer cartridge 20 to the main body 1 is released, and the developer cartridge 20 may be removed.

The developer cartridge 20 may include a body 20*a* having a rear side 20*b* and a front side(front portion) 21. The developer cartridge 20 may be provided with a handle 5. As an example, the handle 5 may be provided at a portion of the developer cartridge 20 facing the door 4, for example, the front portion 21. The handle 5, in conjunction with the movement of the developer cartridge 20 from the mounting position 3*a* to the removal position 3*b* of the developer cartridge 20, may be switched from a first position adjacent to a side of the developer cartridge 20, for example, the front portion 21, to a second position protruding from the side, for example, the front portion 21, so as to be gripped. According to such a configuration, when the developer cartridge 20 is located at the mounting position 3*a*, the handle 5 is located at the first position, so that the handle 5 cannot be gripped. Therefore, arbitrary removal of the developer cartridge 20 may be prevented. Further, when the developer cartridge 20 is located at the removal position 3*b*, the handle 5 is located at the second position where the handle 5 can be gripped, so that the developer cartridge 20 may be easily removed by holding the handle 5.

The release member 6 may apply a force to the rear side 20*b* of the body 20*a* of the developer cartridge 20 to push the developer cartridge 20 in the removal direction B. Hereinafter, examples of the releasing member 6 for moving the developer cartridge 20 from the mounting position 3*a* to the removal position 3*b* and examples of an interlocking structure of movement of the developer cartridge 20 from the mounting position 3*a* to the removal position 3*b* and switching of the handle 5 to the first and second positions will be described.

FIGS. 3 to 5 are views of a process in which the developer cartridge 20 moves from the mounting position 3*a* to the removal position 3*b*. FIG. 3 shows a state in which the developer cartridge 20 is located in the mounting position 3*a*, FIG. 4 shows a state in which locking of the developer cartridge 20 is released, and FIG. 5 shows a state in which the developer cartridge 20 is located in the removal position 3*b*.

Referring to FIGS. 3 to 5, the releasing member 6 may include a cam 61 and a motor 62 for rotating the cam 61. The motor 62 may be a dedicated motor for driving the cam 61. The motor 62 may be a main motor that drives rotational elements of a printer. In this case, a clutch (not shown) for selectively transmitting rotational force of the motor 62 to the cam 61 may be interposed between the motor 62 and the cam 61. Although not shown in the drawings, the releasing member 6 may be implemented in various forms such as a linear actuator having a stroke that can push the developer cartridge 20 from the mounting position 3*a* to the removal position 3*b*.

The developer cartridge 20 is provided with a rocker arm 7. The rocker arm 7 may be switched between a third position (FIG. 3) for respectively holding the developer cartridge 20 and the handle 5 at a mounting position 3*a* and the first position and a fourth position (FIG. 4) for respectively allowing the developer cartridge 20 and the handle 5 to be switched to the removal position 3*b* and the second position. The rocker arm 7 may be switched from the third position to the fourth position by movement of the developer cartridge 20 from the mounting position 3*a* to the removal position 3*b*. For example, the rocker arm 7 may be installed in the developer cartridge 20 so as to be pivotable to the third and fourth positions around a pivot shaft 22. A first elastic member 81 applies elastic force to the rocker arm 7 in a direction held in the third position. The first elastic member 81 may be implemented in various forms such as a coil spring, a leaf spring, and the like. In the example, a torsion coil spring is employed as the first elastic member 81.

As an example, the handle 5 may be installed on the developer cartridge 20 so as to be pivotable around a pivot shaft 23 in the first position (FIG. 3) and the second position (FIG. 4). For example, the front portion 21 of the developer cartridge 20 may be provided with a sunken portion 24, which is sunken in the mounting direction A. The handle 5 may be located in the sunken portion 24 at the first position and may be pivoted at the second position so as to protrude from the front portion 21 by coming out of the sunken portion 24. A second elastic member 82 applies elastic force to the handle 5 in a direction of switching to the second position. The second elastic member 82 may be implemented in various forms such as a coil spring, a leaf spring, and the like. In the example, a torsion coil spring is employed as the second elastic member 82. The second elastic member 82 may be implemented by an elastic arm formed integrally with the handle 5 as shown in FIG. 7 (*d*).

Referring to FIG. 3, the developer cartridge 20 is mounted to the main body 1 and located at the mounting position 3*a*. A bottom dead portion 61*a* of the cam 61 faces the developer cartridge 20. The rocker arm 7 is located at the third position to hold the developer cartridge 20 in the mounting position and simultaneously hold the handle 5 in the first position. For example, the rocker arm 7 may have a first locking portion 71 and a second locking portion 72. The main body 1 may be provided with a first latching portion(latching portion) 31 for latching the first locking portion 71 when the rocker arm 7 is located at the third position. The handle 5 may be provided with a second latching portion(handle latching portion) 51 for latching the second locking portion 72 when the rocker arm 7 is located at the third position. The first and second locking portions 71 and 72 may be hook-shaped and the first and second latching portions 31 and 51 may have a complementary shape interlocking with the first and second locking portions 71 and 72. According to such a configuration, the developer cartridge 20 and the handle 5 are respectively held in the mounting position 3*a* and the first position by the rocker arm 7 in a state where the developer cartridge 20 is mounted to the main body 1.

In order to remove the developer cartridge 20, the control unit drives the motor 62 to rotate the cam 61. The cam 61 pushes the developer cartridge 20 in the removal direction B. When the developer cartridge 20 is pushed in the removal direction B, reaction force is applied to the first locking portion 71 by the first latching portion 31 and the rocker arm 7 is rotated in the opposite direction of the elastic force of the first elastic member 81 and located at the fourth position. Then, as shown in FIG. 4, the latching of the first locking portion 71 and the first latching portion 31 is released, and the latching of the second locking portion 72 and the second latching portion 51 is also released. The handle 5 is rotated to the second position by the elastic force of the second elastic member 82.

When the cam 61 is continuously rotated, the developer cartridge 20 continues to be pushed in the removal direction B. When a top dead portion 61*b* of the cam 61 faces the developer cartridge 20, the developer cartridge 20 is located at the removal position 3*b* as shown in FIG. 5. The rocker arm 7 is returned to the third position by the elastic force of the first elastic member 81. The control unit, in preparation for re-mounting of the developer cartridge 20, may rotate the cam 61 until the bottom dead portion 61*a* faces the developer cartridge 20 as shown by a dashed line in FIG. 5 and may stop the cam 61 at that position.

The developer cartridge 20 may be removed from the main body 1 in this state. Since the handle 5 is located at the second position, a user may remove the developer cartridge 20 from the main body 1 by pulling the developer cartridge 20 in the removal direction B by holding the handle 5, so that the ease of removal may be improved.

A process of mounting the developer cartridge 20 to the main body 1 is a reverse order of the removal process described above. The cam 61 is in a state in which the bottom dead portion 61*a* faces the developer cartridge 20 as shown by the dashed line in FIG. 5. The developer cartridge 20 is pushed into the main body 1 in the mounting direction A in accordance with the mounting portion 3. When the developer cartridge 20 reaches the position shown in FIG. 4 through the removal position 3*b*, the rocker arm 7 is rotated in the opposite direction of the elastic force of the first elastic member 81 from the third position while the first locking portion 71 and the first latching portion 31 interfere with each other in the reverse direction. When the developer cartridge 20 reaches the mounting position 3*a* shown in FIG. 3, the rocker arm 7 is returned to the third position by the elastic force of the first elastic member 81, and the first locking portion 71 is latched to the first latching portion 31 and the developer cartridge 20 is locked to the mounting position 3*a*.

The handle 5 may be located at the second position even after the developer cartridge 20 reaches the mounting position 3*a*. In this case, the handle 5 may be pressed to be switched from the second position to the first position. When the handle 5 located at the second position is rotated in the first position by being pushed in a direction opposite the elastic force of the second elastic member 82, the rocker arm 7 is slightly rotated in a direction opposite the elastic force of the first elastic member 81 from the third position while the second locking portion 72 and the second latching portion 51 interfere with each other in the reverse direction. When the handle 5 reaches the first position as shown in FIG. 3, the rocker arm 7 is returned to the third position by the elastic force of the first elastic member 81 and the second locking portion 72 is latched to the second latching portion 51 so that the handle 5 is held in the first position.

FIG. 6 shows a behavior of the rocker arm 7 in a process of switching the handle 5 from the second position to the first position. Referring to FIG. 6, a first latching distance C1 between the first locking portion 71 and the first latching portion 31 is greater than a second latching distance C2 between the second locking portion 72 and the second latching portion 51. The rocker arm 7 may have an intermediate position (a position shown by a dashed line in FIG. 6) where latching of the first locking portion 71 and the first latching portion 31 is maintained between the third position and the fourth position and latching of the second locking portion 72 and the second latching portion 51 is released.

As described above, in a process of returning the handle 5 from the second position to the first position, the rocker arm 7 is slightly rotated in a direction opposite the elastic force of the first elastic member 81 from the third position while the second locking portion 72 and the second latching portion 51 interfere with each other in the reverse direction. Since the first latching distance C1 is greater than the second latching distance C2, as shown by a dashed line in FIG. 6, the latching of the first locking portion 71 and the first latching portion 31 is maintained even when the reverse interference between the second locking portion 72 and the second latching portion 51 becomes maximum. That is, before reaching the fourth position, the rocker arm 7 reaches an intermediate position where the reverse interference between the second locking portion 72 and the second latching portion 51 becomes maximum, and the handle 5 may be returned from the second position to the first position. Therefore, even when the handle 5 is switched from the second position to the first position, locking of the developer cartridge 20 to the mounting position 3*a* may be maintained.

The form of the handle 5 and the mode of switching to the first and second positions may vary. FIG. 7 shows various forms of the handle 5. As shown in FIG. 7 (*a*), the handle 5 may have a size corresponding to a shape of the front portion 21 of the developer cartridge 20. This configuration may guide a user to push the developer cartridge 20 in the mounting direction A while pressing the handle 5 when the developer cartridge 20 is mounted to the main body 1. The handle 5 may be switched from the second position to the first position by the mounting operation of the developer cartridge 20. Therefore, there is no need to perform an additional operation of pressing the handle 5 to switch the handle 5 from the second position to the first position after the developer cartridge 20 reaches the mounting position 3*a*, and user convenience may be improved.

As shown in FIG. 7 (*b*), the handle 5 may be smaller than the front portion 21 of the developer cartridge 20. When a user removes the developer cartridge 20 from the main body 1 with one hand, the user may drop the developer cartridge 20 without supporting the weight of the developer cartridge 20 as soon as the developer cartridge 20 completely disengages from the mounting portion 3. Such a small handle 5 is used for pulling the developer cartridge 20 in the removal direction B to remove the developer cartridge 20 from the main body 1 and may guide the user to hold the developer cartridge 20 with the other hand after a certain portion of the developer cartridge 20 is slid out of the main body 1. Accordingly, the developer cartridge 20 may be removed safely, and the risk of breakage due to the dropping of the developer cartridge 20 in the process of removing the developer cartridge 20 may be reduced.

In FIGS. 7 (*a*) and (*b*), the handle 5 is rotated in a longitudinal direction to be switched to the first and second positions. As shown in FIG. 7 (*d*), the handle 5 may be rotated in a lateral direction to be switched to the first and second positions. Furthermore, as shown in FIG. 7 (*c*), the handle 5 may move in forward and backward directions, that is, in the mounting direction A and the removal direction B to be switched to the first and second positions.

The handle 5 and the rocker arm 7 may be integrally formed. FIGS. 8 and 9 are schematic cross-sectional views showing an example of the developer cartridge 20 employing a handle formed integrally with a rocker arm. FIG. 8 shows a state in which the developer cartridge 20 is located in the mounting position 3*a*, and FIG. 9 shows a state in which the developer cartridge 20 is located in the removal position 3*b*.

Referring to FIGS. 8 and 9, a handle 100 is provided with a grip portion 120 that can be gripped by a user. The grip portion 120 of the handle 100, in conjunction with the movement of the developer cartridge 20 from the mounting position 3*a* to the removal position 3*b* of the developer cartridge 20, may be switched from a first position (FIG. 8) adjacent to a side of the developer cartridge 20, for example, the front portion 21, to a second position (FIG. 9) protruding from the side, for example, the front portion 21, so as to be gripped. For example, at the first position, the grip portion 120 may be located in the sunken portion 24 provided at the front portion 21 and may protrude from the sunken portion 24 at the second position.

For example, the handle 100 may be installed on the developer cartridge 20 so as to be pivotable around a pivot shaft 101 in the first position and the second position. The handle 100 provides a locking portion 110 which is latched to the latching portion 32 provided in the main body 1 at the first position to lock the developer cartridge 20 to the mounting position 3*a* and released from the latching portion 32 at the second position. The locking portion 110 may have a hook shape and the latching portion 32 may have a complementary shape interlocking with the locking portion 110. A third elastic member 130 applies elastic force to the handle 5 in a direction of switching to the first position. The third elastic member 130 may be implemented in various forms such as a coil spring, a leaf spring, and the like. The third elastic member 130 may be implemented by an elastic arm integrally formed with the handle 100 and having one end supported by the front portion 21. In the example, a tension coil spring is employed as the third elastic member 130. The main body 1 may be provided with an interference portion 33 for interfering with the locking portion 110 when the developer cartridge 20 is located at the removal position 3*b* to hold the handle 100 in the second position. Although not shown in FIG. 8, the developer cartridge 20 may move from the mounting position 3*a* to the removal position 3*b* by the releasing member 6 shown in FIG. 3.

Referring to FIG. 8, the developer cartridge 20 is mounted to the main body 1 and located at the mounting position 3*a*. The handle 100 is located at the first position and the locking portion 110 is latched to the latching portion 32. According to such a configuration, the developer cartridge 20 and the handle 100 are respectively held in the mounting position 3*a* and the first position in a state where the developer cartridge 20 is mounted to the main body 1.

When the developer cartridge 20 is pushed in the removal direction B by the releasing member 6, a reaction force is applied to the locking portion 110 by the latching portion 32 and the handle 100 is rotated in the opposite direction of the elastic force of the third elastic member 130 and located at the second position. Then, as shown in FIG. 9, the latching of the locking portion 110 and the latching portion 32 is released. The developer cartridge 20 is continuously pushed by the releasing member 6 in the removal direction B to reach the removal position 3*b*. The locking portion 110 is brought into contact with the interference portion 33. Thus, the handle 100 is held in the second position.

The developer cartridge 20 may be removed from the main body 1 in this state. Since the handle 100 is located at the second position, a user may remove the developer cartridge 20 from the main body 1 by pulling the developer cartridge 20 in the removal direction B by holding the grip portion 120 of the handle 100, so that the ease of removal may be improved. When the developer cartridge 20 is completely removed from the main body 1, the handle 100 is returned to the first position by the elastic force of the third elastic member 130.

A process of mounting the developer cartridge 20 to the main body 1 is a reverse order of the removal process described above. The developer cartridge 20 is pushed into the main body 1 in the mounting direction A in accordance with the mounting portion 3. When the developer cartridge 20 passes the removal position 3*b*, the locking portion 110 and the interference portion 33 interfere with each other, and the handle 100 is rotated in a direction opposite the elastic force of the third elastic member 130. When the developer cartridge 20 reaches the mounting position 3*a* as shown in FIG. 8, the handle 100 is returned to the first position by the elastic force of the third elastic member 130, and the locking portion 110 is latched to the latching portion 32 and the developer cartridge 20 is locked to the mounting position 3*a*.

According to such a configuration, since the handle 100 is returned to the first position by the operation of mounting the developer cartridge 20 to the mounting portion 3, there is no need for a user to perform additional operations for returning the handle 100 to the first position. Further, since the handle 100 also locks the developer cartridge 20 to the main body 1, material cost may be reduced.

It should be understood that the disclosure described herein should be considered in a descriptive sense and is not intended to be limiting. Descriptions of features within each example should be considered as available for other similar features in other examples. Therefore, the scope of the disclosure is defined not by the detailed description of the disclosure but by the appended claims.

The invention claimed is:

1. A printer, comprising:

a main body including a printing unit to print an image on a printing medium and including an interior space to accommodate a removable developer cartridge that includes a developer to be supplied to the printing unit;

a releasing member, provided in a rear portion of the interior space of the main body, that when the developer cartridge is installed in the main body and is to be removed from the main body, is to rotate so as to move the developer cartridge in a removal direction to remove the developer cartridge from the main body; and a latching portion, provided in a front portion of the interior space of the main body, that when the developer cartridge is installed in the main body is latched to a portion of the developer cartridge so that a handle of the developer cartridge is maintained in a first position, and when the developer cartridge is removed from the main body the latching portion is unlatched from the portion of the developer cartridge so that the handle is concurrently moved to a second position to protrude from the developer cartridge; and a rocker arm provided on the developer cartridge to switch between a third position at which the rocker arm holds the handle at the first position, and a fourth position at which the rocker arm allows the handle to be switched to the second position.

2. The printer of claim 1, wherein when the rocker arm is in the third position the rocker arm holds the developer cartridge at a mounting position where the developer cartridge is locked to the main body, and when the rocker arm is in the fourth position the rocker arm allows the developer cartridge to move to a removal position where the developer cartridge is unlocked from the main body;

the developer cartridge further including:

a first elastic member to apply an elastic force to the rocker arm in a direction so that the rocker arm is held in the third position; and a second elastic member to apply an elastic force to the handle in a direction to switch the handle to the second position.

3. The printer of claim 2, wherein the rocker arm is switched from the third position to the fourth position by the movement of the developer cartridge to the removal position.

4. The printer of claim 3, wherein the rocker arm has a first locking portion and a second locking portion, the portion of the developer cartridge corresponds to the first locking portion and the latching portion is to latch to the first locking portion when the rocker arm is located at the third position, and the handle is provided with a handle latching portion to latch the second locking portion when the rocker arm is located at the third position.

5. The printer of claim 4, wherein the rocker arm includes an intermediate position between the third position and the fourth position, where the latching of the first locking portion and the latching portion is maintained and the latching of the second locking portion and the handle latching portion is released.

6. The printer of claim 5, wherein a first latching distance between the first locking portion and the latching portion is greater than a second latching distance between the second locking portion and the handle latching portion.

7. The printer of claim 1, wherein the handle includes a locking portion, and the portion of the developer cartridge corresponds to the locking portion and the locking portion is latched to the latching portion when the handle is at the first position to lock the developer cartridge to a mounting position where the developer cartridge is locked to the main body and the locking portion is released from the latching portion when the handle is at the second position.

8. The printer of claim 7, wherein the developer cartridge includes an elastic member to apply an elastic force to the handle in a direction to switch the handle to the first position.

9. The printer of claim 8, wherein the main body includes an interference portion to interfere with the locking portion to hold the handle in the second position when the developer cartridge moves from the mounting position to a removal position where the developer cartridge is unlocked from the main body.

10. A developer cartridge which is installable in a printer, the developer cartridge comprising:

a body having a rear side and a front side;

a handle, provided on the front side of the body, movable between a first position at which the handle is adjacent to the front side of the body to a second position at which the handle protrudes from the front side of the body; and a rocker arm provided in the developer cartridge to move from a third position, at which the developer cartridge is locked to a main body of the printer when the developer cartridge is installed in the main body, to a fourth position, at which the developer cartridge is unlocked from the main body when the developer cartridge is removed from the main body by a force applied to the rear side of the body in a rear to front direction of the body, wherein the handle is to move from the first position to the second position when the rocker arm moves from the third position to the fourth position.

11. The developer cartridge of claim 10, further comprising:

a first elastic member to apply an elastic force to the rocker arm in a direction so that the rocker arm is held in the third position; and a second elastic member to apply an elastic force to the handle in a direction to switch the handle to the second position, wherein the rocker arm has a first locking portion and a second locking portion, the main body of the printer is provided with a first latching portion to latch the first locking portion when the rocker arm is located at the third position, and the developer cartridge is provided with a second latching portion to latch the second locking portion when the rocker arm is located at the third position.

12. The developer cartridge of claim 11, wherein a first latching distance between the first locking portion and the first latching portion is greater than a second latching distance between the second locking portion and the second latching portion.

13. The developer cartridge of claim 11, wherein the force applied to the rear side of the body of the developer cartridge is applied by a releasing member provided in the main body of the printer to push the developer cartridge in a removal direction to switch the rocker arm from the third position to the fourth position.

14. The developer cartridge of claim 10, wherein the rocker arm and the handle are integrally formed, and the developer cartridge further comprises:

an elastic member to apply an elastic force to the handle in a direction to switch the handle to the first position.

15. The developer cartridge of claim 14, wherein the main body of the printer includes an interference portion to interfere with the rocker arm to hold the handle in the second position when the developer cartridge is moved from a mounting position where the developer cartridge is locked to the main body to a removal position where the developer cartridge is unlocked from the main body.

* * * * *